United States Patent [19]

Williams

[11] 4,193,734

[45] Mar. 18, 1980

[54] BOOM FOR BACKHOE WITH INTERNALLY DISPOSED HYDRAULIC FEED LINES

[75] Inventor: Derrick G. Williams, Sale, England

[73] Assignee: Massey-Ferguson Services N.V., Curacao, Netherlands Antilles

[21] Appl. No.: 921,030

[22] Filed: Jun. 30, 1978

[30] Foreign Application Priority Data

Jul. 12, 1977 [GB] United Kingdom ..... 29205/77

[51] Int. Cl.[2] ..... E02F 3/85

[52] U.S. Cl. ..... 414/694; 212/144; 414/727; 414/918

[58] Field of Search ..... 214/138 R, 140, 141, 214/145 R; 52/115, 116; 212/144; 138/106, 107; 414/694, 697, 718, 722, 727, 918

[56] References Cited

U.S. PATENT DOCUMENTS

| | | | |
|---|---|---|---|
| 2,961,106 | 11/1960 | Davis | 214/138 R |
| 3,220,578 | 11/1965 | Pilch | 214/138 R |
| 3,524,560 | 8/1970 | Hall | 214/138 R |

FOREIGN PATENT DOCUMENTS

| | | | |
|---|---|---|---|
| 85191 | 3/1958 | Denmark | 214/138 R |
| 2639077 | 3/1977 | Fed. Rep. of Germany | 214/138 R |
| 1463255 | 11/1966 | France | 214/138 R |
| 613065 | 11/1960 | Italy | 214/138 R |

*Primary Examiner*—L. J. Paperner

*Attorney, Agent, or Firm*—William R. Nolte

[57] ABSTRACT

A lifting machine boom having two side walls maintained in spaced relationship to each other by a bottom wall and a top wall and a median reinforcing member dividing the interior of the boom into the first and second longitudinally extending chambers. One or more rigid pipes are attached to the median wall and run longitudinally of the boom from locations adjacent the ends. These pipes conduct pressurized fluid to and from one or more actuators carried by or associated with the boom. One said actuator is disposed in the second chamber.

5 Claims, 7 Drawing Figures

58
94
98
96
88,90,92
62
84
104
82
64
76
69
68
74
78
52
66
60
72
113
70
14
80

BOOM FOR BACKHOE WITH INTERNALLY DISPOSED HYDRAULIC FEED LINES

BACKGROUND OF THE INVENTION

This invention relates to lifting machine booms and material handling machines and particularly to diggers and the like.

Diggers typically include a boom pivoted on the vehicle, a dipper pivoted to the boom and a bucket pivoted to the dipper. The boom must be strong enough to support the dipper, the bucket and its load and also must support the separate hydraulic actuators by which the positions of the boom, dipper and bucket are adjusted relative to the vehicle and to each other plus all of the hydraulic pipework. The hydraulic pipework is vulnerable to damage but if protected must be accessible for replacement and repair.

It is an aim of the invention to provide a boom structure for a lifting machine, particularly a digger, which is rigid and supports components of the hydraulic system in a manner which protects them from damage and at the same time makes them accessible for replacement and repair.

SUMMARY OF THE INVENTION

According to the present invention a lifting machine boom having a first pivot means at one end comprises two side walls connected along their length by a bottom wall, a median wall and an upper wall, said median wall dividing the interior of the boom into first and second longitudinally extending chambers, second pivot means on said side walls located within said second chamber for the purpose of attaching one end of a hydraulic actuator used for elevating the boom about said first pivot means, at least a first rigid pipe attached to said median wall and arranged to run longitudinally of the boom within said first chamber from a first end located adjacent said one end of the boom to a second end located nearer the other end of the boom, said second end being provided for connection with said hydraulic actuator.

The second pivot means is preferably located longitudinally of the boom between said first pivot means and said second rigid pipe end.

Preferably also at least one of said walls is provided with apertures to provide access to the ends of said first rigid pipe.

The boom may be provided with a third pivot means adjacent said second chamber for mounting a further hydraulic actuator, and at least a further rigid pipe for connection with said further hydraulic actuator, may be attached to said median wall and arranged to extend longitudinally within said first chamber in a manner similar to said first rigid pipe.

According to another aspect the invention we provide a boom for a digger comprising a pair of longitudinally extending parallel side wall members, a bottom wall and a top wall connected to said side wall members and maintaining them in parallel spaced relationship to each other, a reinforcing member connected to said side wall members in parallel spaced relationship to said bottom wall and forming a generally longitudinally extending first chamber within said boom on one side of said reinforcing member, a plurality of rigid hydraulic pipes extending longitudinally of the boom and disposed in said first chamber and having opposite ends adapted for connection to flexible hydraulic hoses, and access openings formed in said top wall and in said reinforcing member adjacent said opposite ends of said hydraulic lines.

A hydraulic actuator may be disposed in a second chamber formed within the boom on the other side of said reinforcing member, said hydraulic actuator being connected with selected ones of said rigid pipes via flexible hydraulic hoses.

Preferably said plurality of rigid pipes are detachably connected to said reinforcing member for mounting and disconnecting independently of each other.

BRIEF DESCRIPTION OF THE DRAWINGS

One embodiment of the invention will now be described, by way of example only, with reference to the accompanying drawings of which.

DESCRIPTION OF A PREFERRED EMBDOIMENT

Figures 1, 2, 3:
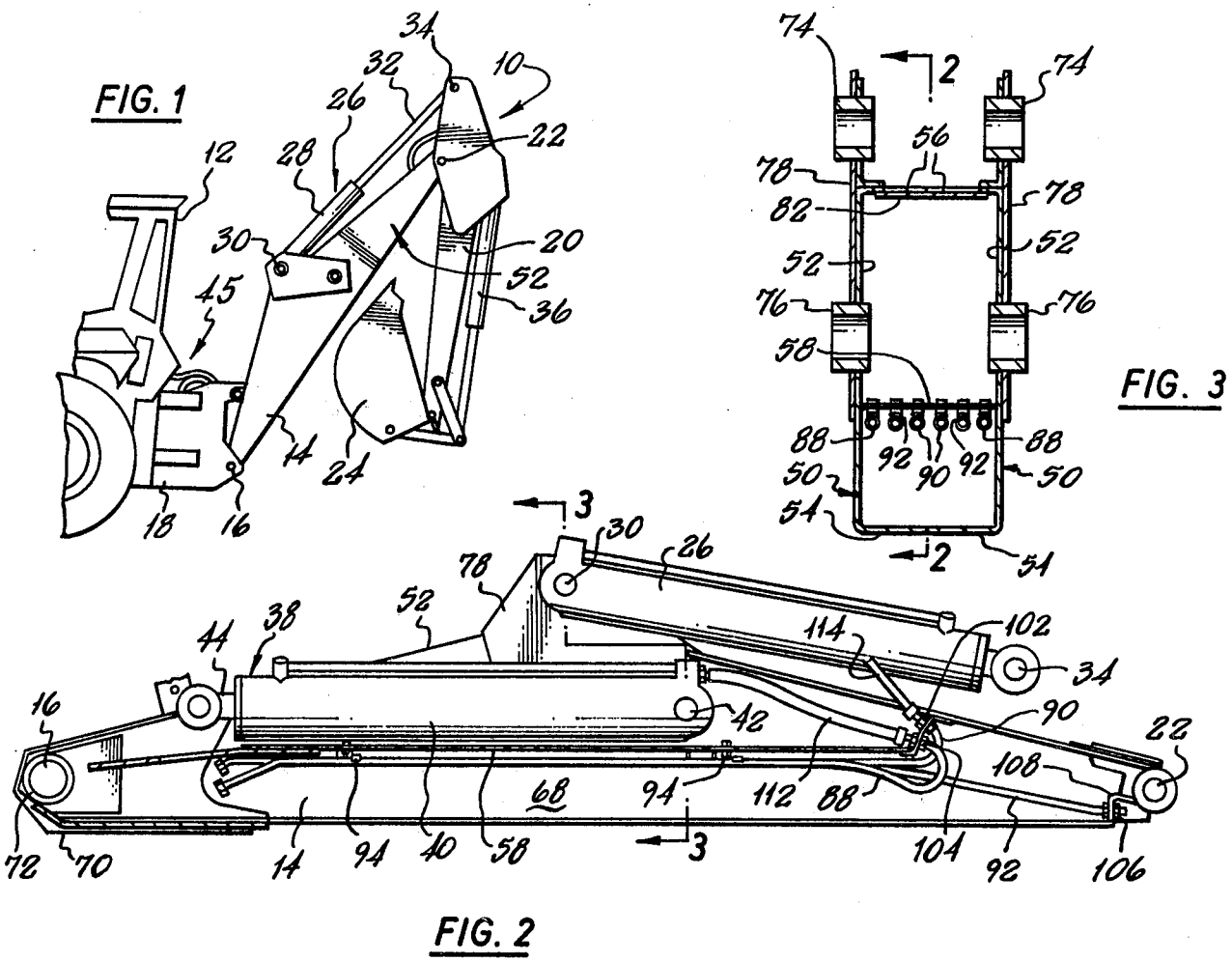
FIG. 1 is a side elevation of a backhoe connected to a tractor, only the rear portion of which is shown.
FIG. 2 is a sectional view on line 2—2 (FIG. 3) of the boom in FIG. 1 but at an enlarged scale.
FIG. 3 is a cross-sectional view taken on line 3—3 in FIG. 2.

Referring to the drawings and particularly to FIG. 1, a digger 10 is supported from the rear of a tractor a portion of which is shown at 12. The digger 10 includes a boom 14 pivoted for vertical swinging movement about a transverse first pivot 1 to a swivel member 18 which permits swinging movement of the entire digger about a generally vertical axis. A dipper 20 is pivoted to the end of the boom 14 for swinging about the axis of a pivot pin 22. The outer end of the dipper 20 pivotally supports a bucket 24. The angular position of the dipper 20 relative to the boom 14 is controlled by a hydraulic actuator 26 having a cylinder 28 pivotally connected by a pin 30 to the boom 14 and a reciprocating rod 32 pivotally connected by pin 34 to the dipper 20. The angular relationship between the bucket 24 and the dipper 20 is under the control of a hydraulic actuator 36 having opposite ends connected to the dipper 20 and bucket 24.

The angular relationship between the boom 14 and the swivel member 18 may be changed by actuating a hydraulic actuator 38 seen in FIG. 2 and having a cylinder 40 pivotally connected by a pin 42 to the boom 14 and having a reciprocating rod 44 the end of which is adapted to receive a pivot pin, not shown, on the swivel member 18.

The various angular relationships between the bucket 24, the dipper 20, the boom 14 and the swivel member 18 are under the control of hand operated valves, not shown, at the operator's station on the vehicle. These valves control the delivery and return of hydraulic fluid from a hydraulic source on the vehicle to the hydraulic actuators 26, 36 and 38 through a cluster of hydraulic lines indicated at 45 in FIG. 1.

The boom 14 is an elongated box-like structure made up of a pair of channels 50 each of which has a generally triangular web or side wall 52, a bottom flange 54 extending substantially the full length of the channel and a top flange 56 which extends for aproximately one half the length of the channel at the outer end of the boom 14. The channels 50 have their abutting edges of the bottom and top flanges 54 and 56 welded together to form a generally box-like structure as best seen in FIG. 3.

A reinforcing plate member 58 extends for substantially the full length of the boom in parallel spaced relationship to the bottom flange 54 and is welded at its opposite parallel edges to the side walls 52. An extension plate 60 is welded to one end of the plate member 58 and to the side walls 52 of the channel members 50 to extend the plate member 58.

A pair of access openings 62 and 64 are formed in the top flange 56 and the extension plate 60 contains an access opening 66. The plate 58 divides the interior of the boom 14 to form a long first chamber 68 on one side and a shorter second chamber 69 on the other side. The plate member 58 also serves to stiffen and make the boom rigid.

The inner end of the boom 14 is reinforced with side plates 70 welded to the opposed walls 52 and supporting tubular bosses 72 which receive opposite ends of the shaft 16 forming the first pivot means of the boom 14 relative to the swivel member 18.

The pin 30 supporting the cylinder of the hydraulic actuator 26 and pin 42 supporting the cylinder 40 of the hydraulic actuator 38 are supported respectively by axially aligned pairs of tubular bosses 74 and 76 carried by reinforcing plates 78 which are welded to side walls 52. The bosses 76 provide the second pivot means of the boom and the bosses 74 the third pivot means.

Further reinforcement is afforded by a stiffener plate 80 welded to the bottom of the boom 14. The boom 14 also is reinforced by a stiffener plate 82 welded within the channels 50 at the underside of the top flanges 56. An angular extension plate 84 is welded to and at the apex of the triangular side walls 52.

The operation of the digger 10 requires the conveying of hydraulic fluid to and form the hydraulic actuators 26, 36 and 38. This requires a minimum of six hydraulic conduits which in the present instance are formed of rigid piping secured to the plate member 58 which thus also serves as a mounting bulkhead.

As best seen in FIGS. 2 and 3, outboard pipes 88 serve to deliver hydraulic fluid to and from the hydraulic actuator 38 for controlling the boom. The inboard pair of pipes 90 supply hydraulic fluid to the bucket hydraulic actuator 36. Similarly the intermediate pipes 92 supply hydraulic fluid to and from the hydraulic actuator 26 which is used to change the angle between the boom 14 and dipper 20.

Figures 4, 5, 6, 7:
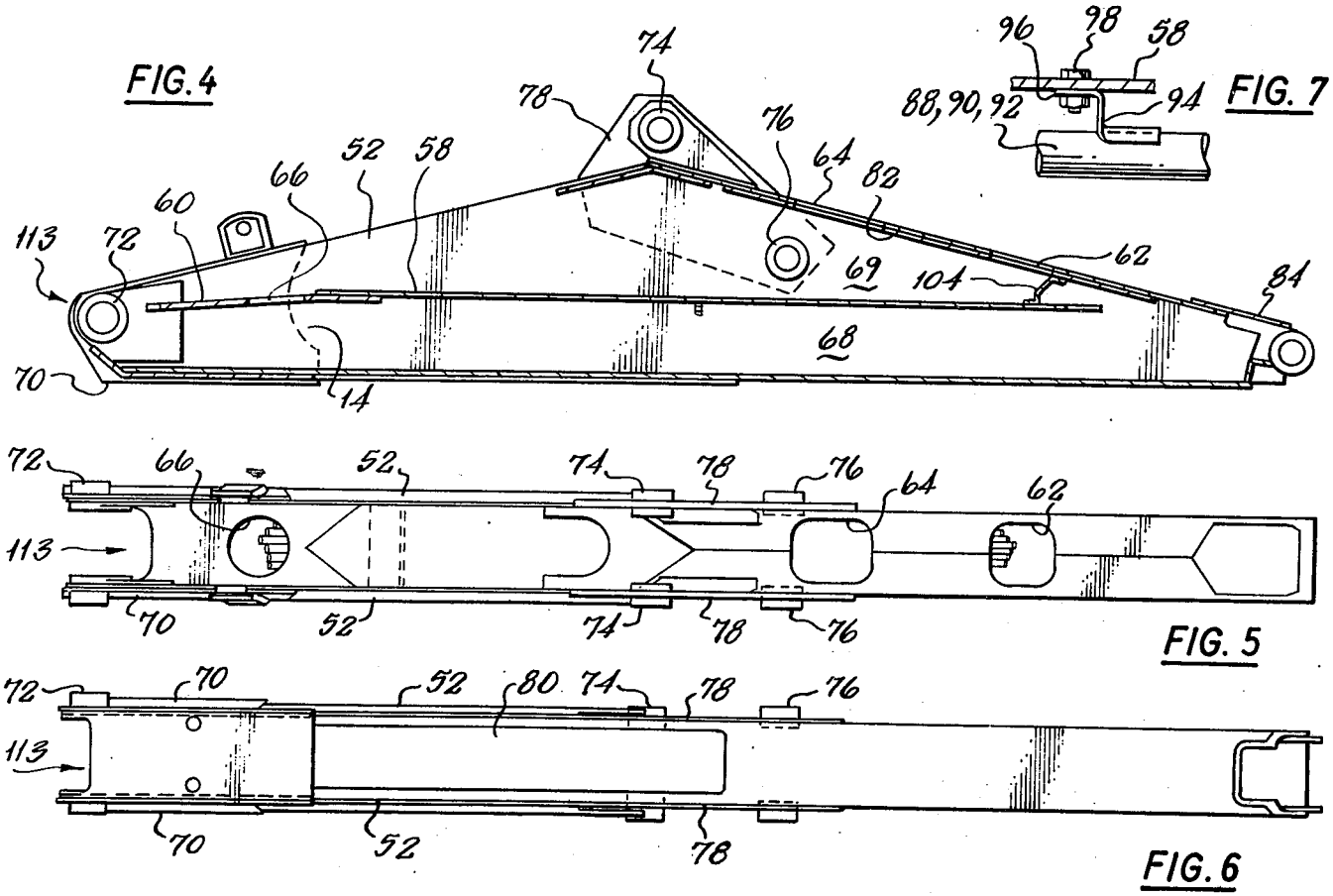
FIG. 4 is a sectional view similar to FIG. 2 but with some of the parts removed in the interest of clarity.
FIG. 5 is a view from above the boom seen in FIG. 4.
FIG. 6 is a view from below of the boom seen in FIG. 4.
FIG. 7 is a view at an enlarged scale of one of the tube brackets seen also in FIG. 2.

As best seen in FIG. 7 the pipes 88, 90 and 92 are held in position relative to the plate member 58 by brackets 94 which are brazed to the pipes at longitudinally spaced points. Each of the brackets 94 includes an angular pad 96 which is adapted to be held in position by means of a bolt 98. It will be appreciated that other means could be used to attached brackets 94 to the pipes 88-92 such as clamping. One make of clamp which could be used in that made under the United States of America trade mark "Hydro Zorb" wherein the clamping system would be attached to the plate member 58. The outer ends of the pipes 88 and 90 also are supported through a threaded fitting 102 to a bracket 101 fastened to the plate member 58. Similarly, the outer ends, of pipes 92 are supported through a threaded fitting 106 carried by a bracket 108.

The hydraulic conduits or pipes 88, 90 and 92 are concealed and protected within chamber 68 of the boom 14 and are mounted on the plate 58 so that their outer ends are presented towards the chamber 69 and the actuators 38 and 26 so as to be connected easily thereto.

The access opening 62 formed in the top flange 58 make it possible to attach and detach flexible hydraulic conduits 112 and 114 to the ends of pipes 88 and 90, respectively. Similarly, the access opening 64 affords space to attach the hydraulic conduits 112 to the cylinder 40 of the hydraulic actuator 38.

The inboard ends of all six of the tubes 88, 90 and 92 can be reached through access opening 66 in the plate member 58 to permit attachment and detachment of the flexible hydraulic hoses 45. The rigid hydraulic pipes 88, 90 and 92 which are preferably of steel are subject to high hydraulic pressures, for example, to the order of 4,500 psi. These are inserted into the chamber 68 through the open inner end of the boom 14 as indicated by the arrow 113.

The plate 58 serves to form a more rigid boom structure and at the same time forms a mounting bulkhead to support and protect the hydraulic pipes, the opposite ends of which are readily accessible to receive flexible hydraulic conduits by way of the access openings formed in the boom. This arrangement makes it possible to have a very stiff and rigid boom 14 and at the same time, minimize weight by providing stiffening and reinforcing plates only at those points where additional strength is required and the access openings are located so as to not to detract from the strength of the boom. Additionally, it makes possible the presentation of the ends of the rigid pipes to the actuators 36 and 26 at a point most convenient to both of them.

I claim:

1. A lifting machine boom having two side walls maintained in spaced relationship to each other by a bottom wall and a top wall, first pivot means at one end of the boom and second pivot means on the side walls for the purpose of attaching one end of a hydraulic actuator used for elevating the boom about said first pivot means, a first and second longitudinally extending chambers with said second pivot means within said second chamber, and at least a first rigid pipe attached to said median well and arranged to run longitudinally of the boom within said first chamber from a first end located adjacent said one end of the boom to a second end located nearer the other end of the boom, said second end being provided for connection with said hydraulic actuator.

2. A boom according to claim 1 in which said second pivot means is located longitudinally of the boom between said first pivot means and said second rigid pipe end.

3. A boom according to claim 1 in which at least one of said walls is provided with an aperture to provide access to an end of said first rigid pipe.

4. A boom according to claim 1 in which a third pivot means is provided adjacent said second chamber for mounting a further hydraulic actuator, and at least a further rigid pipe for connection with said further hydraulic actuator is attached to said median wall and arranged to extend longitudinally within said first chamber in a manner similar to said first rigid pipe.

5. A boom according to claim 1 in which the second end of the or each aforementioned rigid pipe is presented towards said second chamber.

* * * * *